US008285166B2

(12) United States Patent
Yamamoto et al.

(10) Patent No.: US 8,285,166 B2
(45) **Date of Patent: *Oct. 9, 2012**

(54) DEVELOPING APPARATUS

(75) Inventors: Shinya Yamamoto, Numazu (JP); Takeshi Kawamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/302,402

(22) Filed: Nov. 22, 2011

(65) Prior Publication Data

US 2012/0070169 A1 Mar. 22, 2012

Related U.S. Application Data

(62) Division of application No. 13/117,255, filed on May 27, 2011, which is a division of application No. 12/144,786, filed on Jun. 24, 2008, now Pat. No. 7,962,057.

(30) Foreign Application Priority Data

Jun. 29, 2007 (JP) ..... 2007-172291

(51) Int. Cl.
*G03G 15/10* (2006.01)

(52) U.S. Cl. ..... 399/61; 399/27; 399/252

(58) Field of Classification Search ..... 399/27, 399/30, 55, 61, 252, 259, 281, 285, 295
See application file for complete search history.

(56) References Cited

U.S. PATENT DOCUMENTS 5,548,382 A 8/1996 Koshi et al.
5,946,522 A 8/1999 Inami
6,275,665 B1 8/2001 Miyashiro
6,415,127 B1 7/2002 Yamamoto et al.
6,738,593 B2 5/2004 Kawamura et al.
6,909,869 B2 6/2005 Yamamoto et al.
6,965,743 B2 11/2005 Nakagawa et al.
7,006,776 B2 2/2006 Matsuzaka et al.
7,031,629 B2 4/2006 Kawamura et al.

(Continued)

FOREIGN PATENT DOCUMENTS

EP 1055975 A2 11/2000

(Continued)

OTHER PUBLICATIONS

Communication dated Nov. 28, 2011, forwarding a European Search Report dated Nov. 14, 2011, in European Application No. 08159187.7-1240/2009512.

(Continued)

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

A developing apparatus including a developing container for containing developer, the developing container having an opening portion, a developer carrying member for carrying the developer at the opening portion, a detecting member for detecting a developer amount, the detecting member detecting a capacitance between the developer carrying member and the detecting member, and a force receiving portion for receiving a force and moving the developing container between a first position in which a developing operation is performed by the developer carrying member and a second position in which the developing operation is not performed, wherein the capacitance can be detected in the second position, and the detecting member is a rotatable developer supplying member for supplying the developer to the developer carrying member, the developer supplying member including a foam layer in which the developer can enter.

9 Claims, 14 Drawing Sheets

U.S. PATENT DOCUMENTS

| | | | |
|---|---|---|---|
| 7,254,350 | B2 | 8/2007 | Kawamura et al. |
| 2002/0150404 | A1 | 10/2002 | Matsuzaka et al. |
| 2005/0008401 | A1 | 1/2005 | Kawamura et al. |
| 2005/0260006 | A1 | 11/2005 | Matsuda et al. |
| 2009/0003884 | A1 | 1/2009 | Kawamura et al. |

FOREIGN PATENT DOCUMENTS

| | | | |
|---|---|---|---|
| EP | 1091262 | A2 | 4/2001 |
| JP | 4-234777 | A | 8/1992 |
| JP | 9-204095 | A | 8/1997 |
| JP | 11-288161 | A | 10/1999 |
| JP | 2002-244414 | A | 8/2002 |
| JP | 2002-278412 | A | 9/2002 |
| JP | 2003-43805 | A | 2/2003 |
| JP | 2004-177765 | A | 6/2004 |
| JP | 2007-86659 | A | 4/2007 |

OTHER PUBLICATIONS

Notification of Reasons for Refusal dated Jul. 2, 2009, in counterpart Japanese Application No. 2007-172291.

Notice of Preliminary Rejection dated Sep. 30, 2009, in counterpart Korean Application No. 10-2008-0061259.

Office Action dated Mar. 2, 2010, in counterpart Japanese Application No. 2009-246666.

PRIOR ART

PRIOR ART

PRIOR ART

DEVELOPING APPARATUS

This application is a divisional of U.S. patent application Ser. No. 13/117,255, filed May 27, 2011, which is a divisional of U.S. patent application Ser. No. 12/144,786, filed Jun. 24, 2008, which issued as U.S. Pat. No. 7,962,057, on Jun. 14, 2011.

BACKGROUND OF THE INVENTION

1. Field of the Invention

The present invention relates to a developing apparatus including a developer carrying member for carrying a developer and a detecting member for detecting a developer amount by detecting the capacitance between the developer carrying member and the detecting member. This developing apparatus can be used for an image forming apparatus, which is preferably an electrophotography apparatus such as a printer or a copying machine.

2. Description of the Related Art

There is proposed a toner remaining amount detecting method of a capacitance detecting type as a method of detecting a remaining amount of developer (hereinafter referred to as toner) stored in the developing apparatus that is used for the image forming apparatus such as the electrophotography apparatus.

For instance, Japanese Patent Application Laid-Open No. 2002-244414 discloses a developing apparatus using a contact developing method illustrated in FIG. 14, in which a developing bias power supply 105 applies an AC voltage generated by periodically turning on and off a DC bias as a developing bias to a developing roller 109 as the developer carrying member.

A voltage induced in an antenna 78 as the detecting member for detecting developer amount is measured based on an alternating electric field formed by turning on and off the developing bias, such that toner amount between the antenna 78 and the developing roller 109 can be detected. In other words, a detector 102 is used to determine whether a space between the antenna 78 and the developing roller 109 is filled with toner, or whether the toner is consumed and does not fill the space.

When the detection of the toner remaining amount is performed, it is desirable to separate the developing roller from a photosensitive drum for eliminating influence of capacitance between them. As to this apparatus, the developing apparatus can swing around a swing center 106 using a contact and separate spring 107 and a contact and separate cam 108 illustrated in FIG. 14, so the developing roller 109 having an elastic property can be made to contact with and to separate from the photosensitive drum.

On the other hand, as to a developing apparatus using jumping development, a method involving detecting the toner remaining amount by utilizing a change in capacitance is proposed, in which a developing bias that is an alternating electric field is applied to a developing sleeve as the developer carrying member.

In particular, as to a developing unit using toner that is nonmagnetic mono-component developer, it is common to provide a developing chamber with a supplying member for supplying developer to the developing sleeve. If the method of detecting the toner remaining amount through a change in capacitance is applied to a developing unit using the nonmagnetic mono-component developer, some problems will occur. For instance, since the supplying member exists, a space for housing the antenna is limited, so the capability of detecting the toner remaining amount may be deteriorated, or the toner may be blocked from being conveyed smoothly.

Therefore, as illustrated in FIG. 15 (or disclosed in Japanese Patent Application Laid-Open No. H04-234777), there is a conventional structure, in which a supplying member 80 is made up of a metal conductive support member 79 and a urethane sponge disposed on the circumference surface of the metal conductive support member 79, and an alternating electric field is applied to a sleeve 75 when the toner is supplied to the sleeve 75. Thus, a voltage corresponding to an amount of the developer is induced on the conductive support member 79, so a remaining amount of the developer can be detected based on the induced voltage.

As to this jumping development, the developing sleeve that is the developer carrying member is opposed to the photosensitive drum with a predetermined gap between them. Therefore, it is not necessary that the developing apparatus can be made contact with and separate as illustrated in FIG. 14.

Japanese Patent Application Laid-Open No. 2002-244414 discloses a structure in which the developing bias of the nonmagnetic mono-component contact developing apparatus is to be the DC bias, which is turned on and off periodically, and an alternating electric field generated in this way is used for detecting the toner remaining amount.

As for the developing apparatus using nonmagnetic mono-component developer, it is necessary to provide the developing chamber 23 with the supplying member 80. For this reason, some problems arise. For instance, a space for housing the antenna 78 is limited, so the capability of detecting the toner remaining amount may be deteriorated, or the toner may be blocked from being conveyed smoothly. In other words, it is disadvantageous to provide a special antenna 78 as a member for detecting the developer amount from a viewpoint of saving space and cost.

In addition, for a purpose of periodically turning on and off the DC bias as the developing bias without causing an image error, the developing roller is separated from the photosensitive drum during periods between printing of individual images (i.e., between so-called paper sheets) as illustrated in FIG. 14.

However, a posture of the toner existing between the developing roller and the antenna when the developing roller contacts with the photosensitive drum during an image forming period is different from a posture of the toner existing between the developing roller and the antenna when the developing roller separates from the photosensitive drum during the period between paper sheets. In this way, since an abutting and separating operation is performed with different postures of the developing apparatus, the amount of toner existing between the developing roller and the antenna changes, which causes a problem that a voltage output varies so that a certain period of time is required before the voltage output becomes stable. In this way, according to the conventional structure, the developer amount is detected with different postures of the developing apparatus. Therefore, accuracy of detection cannot be stable, making it difficult to secure correct detection.

On the other hand, as illustrated in FIG. 15, a developer supplying member is used as a member for detecting the developer amount in a non-contact developing method using the nonmagnetic mono-component developer in which the developing sleeve is separated from the photosensitive drum. This method of detecting the developer amount using the developer supplying member was applied to the contact developing apparatus. More specifically, a developing bias having an AC component superimposed on a DC component was applied to the developing roller from a developing bias power supply 101, so as to measure a voltage that was induced on a conductive metal supporting member of the supplying member made of urethane sponge.

However, when the developing bias having an AC component superimposed on a DC component was applied to the developing roller of the contact developing apparatus using the nonmagnetic mono-component developer, smear on a white background called fog appeared. Further, when the developing roller contacts with the photosensitive drum, hitting vibration occurred between them resulting in an undesirable hitting noise.

In addition, as described above with reference to FIG. 14, if the developer amount is detected in the state where the photosensitive drum contacts with the developing roller, it was difficult to detect the developer amount accurately because of an influence of the capacitance between the photosensitive drum and the developing roller.

SUMMARY OF THE INVENTION

It is an object of the present invention to provide a developing apparatus that does not need a special antenna for detecting capacitance in the developing container and is advantageous for saving space and cost.

Another object of the present invention is to provide a developing apparatus in which a developer supplying member for supplying developer to the developer carrying member is used for detecting capacitance in the developing container.

Still another object of the present invention is to provide a developing apparatus capable of detecting capacitance correctly in the developing container.

Still another object of the present invention is to provide a developing apparatus capable of detecting a developer amount correctly even in the case where a posture of the developing apparatus changes.

Still another object of the present invention is to provide a developing apparatus having improved accuracy in detecting a developer amount in the developing container regardless of a variation in the developer amount.

Other objects and features of the present invention will be apparent from the detailed description below with reference to the attached drawings.

DESCRIPTION OF THE EMBODIMENTS

Now, a developing apparatus according to the present invention will be described with reference to the attached drawings by way of example.

Figure 1:
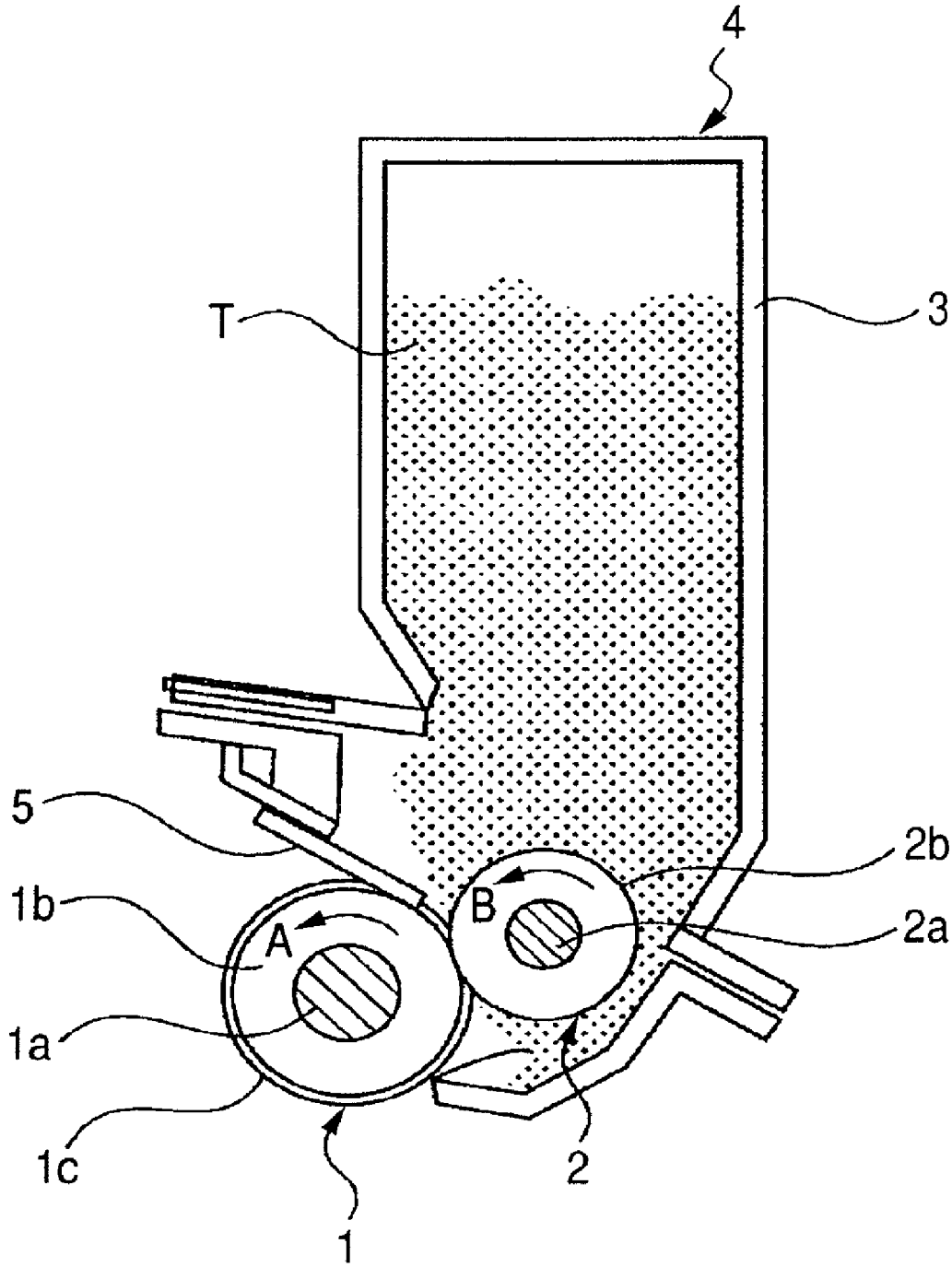
FIG. 1 is a schematic cross sectional view illustrating an example of a developing apparatus to which the present invention is applied.

FIG. 1 is a schematic cross sectional view illustrating an example (example 1) of the developing apparatus to which the present invention is applied.

The developing apparatus includes a developing container 3, a developer carrying member 1, a developer supplying member (developer amount detecting member) 2, and a developer regulating member 5. In FIG. 1, reference numeral 3 denotes a developing container for containing toner T, which is nonmagnetic mono-component developer. A developing roller 1 as the developer carrying member is disposed at an opening portion of the developing container 3 and is supported by the developing container 3 in a rotatable manner. In addition, the developing container 3 is provided with a supplying roller 2 as the developer supplying member that contacts with the developing roller 1 and rotates so as to supply the toner T to the developing roller 1, and a regulating member 5 having an end portion contacting with the developing roller 1 so as to regulate the toner T supplied to the developing roller 1 to be a thin layer. As described later, the developer supplying member also operates as a detecting member for detecting a developer amount in the developing container.

As the developer, nonmagnetic mono-component toner T having negative electrostatic charging property is used. The toner T becomes charged triboelectrically in the negative polarity upon developing, and a degree of compaction of the toner is 15%.

The degree of compaction of the toner was measured as follows.

As a measuring device, a powder tester (by HOSOKAWA MICRON CORPORATION) having a digital vibration meter (DIGITAL VIBRATION METER MODEL 1332 by SHOWA SOKKI CORPORATION) was used.

When the toner was measured, a 390 mesh sieve, a 200 mesh sieve, and a 100 mesh sieve were arranged in increasing order of opening size, that is, the 390 mesh sieve, the 200 mesh sieve, and the 100 mesh sieve were set on a shake table one on top of the other in order so that the 100 mesh sieve was the top layer.

Sample (toner) of 5 grams weighed precisely was applied on the set 100 mesh sieve. A displacement value detected by the digital vibration meter was adjusted to be 0.60 mm (peak-to-peak), and the vibration was applied for 15 seconds. After that, weight of the sample remaining on each of the sieves was measured, and the degree of compaction was obtained based on the equation below.

The sample to be measured had been left for hours under the condition of temperature of 23 degrees centigrade and relative humidity of 60%, and the measurement was carried out under the condition of temperature of 23 degrees centigrade and relative humidity of 60%.

Degree of compaction (%)=(weight of remaining sample on 100 mesh sieve divided by 5 grams)×100+(weight of remaining sample on 200 mesh sieve divided by 5 grams)×60+(weight of remaining sample on 390 mesh sieve divided by 5 grams)×20.

As to the developing apparatus 4, the opening portion of the developing container 3 was disposed at the lower side, so self-weight of the toner T was exerted on the developing roller 1 and the supplying roller 2 disposed at the opening portion. This arrangement enables the developer to easily enter the supplying roller 2 and is preferable for detecting the developer amount in the developing container with high accuracy.

The developing roller 1 includes a conductive support member 1*a* and a semiconductive elastic rubber layer 1*b* containing conductive material around the conductive support member 1*a*, and is rotated in the direction indicated by the arrow A illustrated in FIG. 1. The developing roller 1 has a core metal electrode 1*a* having an outer diameter of 6(mm) as the conductive support member, and a semiconductive silicone rubber layer 1*b* containing conductive material is disposed around the core metal electrode 1*a*. In addition, the surface of the silicone rubber layer 1*b* is coated with an acrylic urethane rubber layer 1*c* having approximately 20 (microns), and a total outer diameter of the developing roller 1 is 12 (mm).

In addition, a resistance of the developing roller 1 of the embodiment of the present invention is $1\times10^6$ (ohms).

Here, a method of measuring resistance of the developing roller will be described.

The developing roller 1 is set to contact with an aluminum sleeve having a diameter of 30 mm by a contact load of 9.8 Newtons. The aluminum sleeve is rotated so that the developing roller 1 is rotated at rpm following the aluminum sleeve. Next, a DC voltage of −50 volts is applied to the developing roller 1. On this occasion, a resistor of 10 kilo ohms is disposed on the ground side so that a voltage across the resistor is measured. Thus, the current is calculated, so a resistance of the developing roller 1 is calculated.

If the volume resistance of the developing roller 1 is larger than $1\times10^9$ (ohms), a voltage value of the developing bias on the surface of the developing roller is lowered so that a DC electric field in a developing region is decreased. Consequently, a developing efficiency is lowered, which causes a problem of a decrease in image density. Therefore, it is preferable to set the resistance of the developing roller 1 to a value equal to or smaller than $1\times10^9$ (ohms).

The supplying roller 2 that is the developer supplying member as well as the developer amount detecting member includes the conductive support member and a foam layer supported by the conductive support member. More specifically, an urethane foam layer 2*b* that is the foam layer made of open cell foam (open cell) in which air bubbles are communicated to each other is disposed around the core metal electrode 2*a* that is the conductive support member having an outer diameter of 5 (mm). The supplying roller 2 is rotated in the direction indicated by the arrow B illustrated in FIG. 1. An outer diameter of the entire supplying roller 2 including the urethane foam layer 2*b* is 13 (mm). Since the urethane of the surface layer is made of open cell foam, a large amount of toner can enter inside the supplying roller. Thus, the performance of toner amount detection that will be described later can be improved.

In addition, a resistance of the supplying roller 2 of the embodiment of the present invention is $1\times10^9$ (ohms).

Here, a method of measuring a resistance of the supplying roller will be described.

The supplying roller 2 is set to contact with the aluminum sleeve having a diameter of 30 mm so that an inroad amount that will be described later becomes 1.5 mm. When this aluminum sleeve is rotated, the supplying roller 2 is rotated at 30 rpm following the aluminum sleeve. Next, a DC voltage of −50 volts is applied to the developing roller 1. On this occasion, a resistor of 10 kilo ohms is disposed on the ground side so that a voltage across the resistor is measured. Thus, the current is calculated, so a resistance of the supplying roller 2 is calculated.

A surface cell size of the supplying roller 2 is selected to be 50 to 1000 microns.

Here, the cell size means an average size of the foam cells in an arbitrary cross section. An area of a largest foam cell is measured from a magnified image in the arbitrary cross section, and a diameter corresponding to a perfect circle is calculated from the area so as to obtain the largest cell size. Foam cells having diameters equal to or smaller than a half of the largest cell size are removed as noises, and individual cell sizes are also calculated from areas of the remaining cells. An average value of the cell sizes is determined.

A surface aeration amount of the supplying roller 2 is selected to be 1.8 (liters per minute) or larger.

The "surface aeration amount" of the supplying roller 2 according to the embodiment of the present invention will be described in detail.

In this embodiment, the "aeration amount" is specified so that delivery and intake of the toner inside and outside the supplying roller is performed smoothly and that an equilibrium state between the inside and outside of the supplying roller can be obtained. The deliver and intake action of the toner that has become powder flow mixed with air is performed through a "surface layer" of the supplying roller, so it is important to directly specify an "aeration amount passing through the surface layer".

Figure 2:
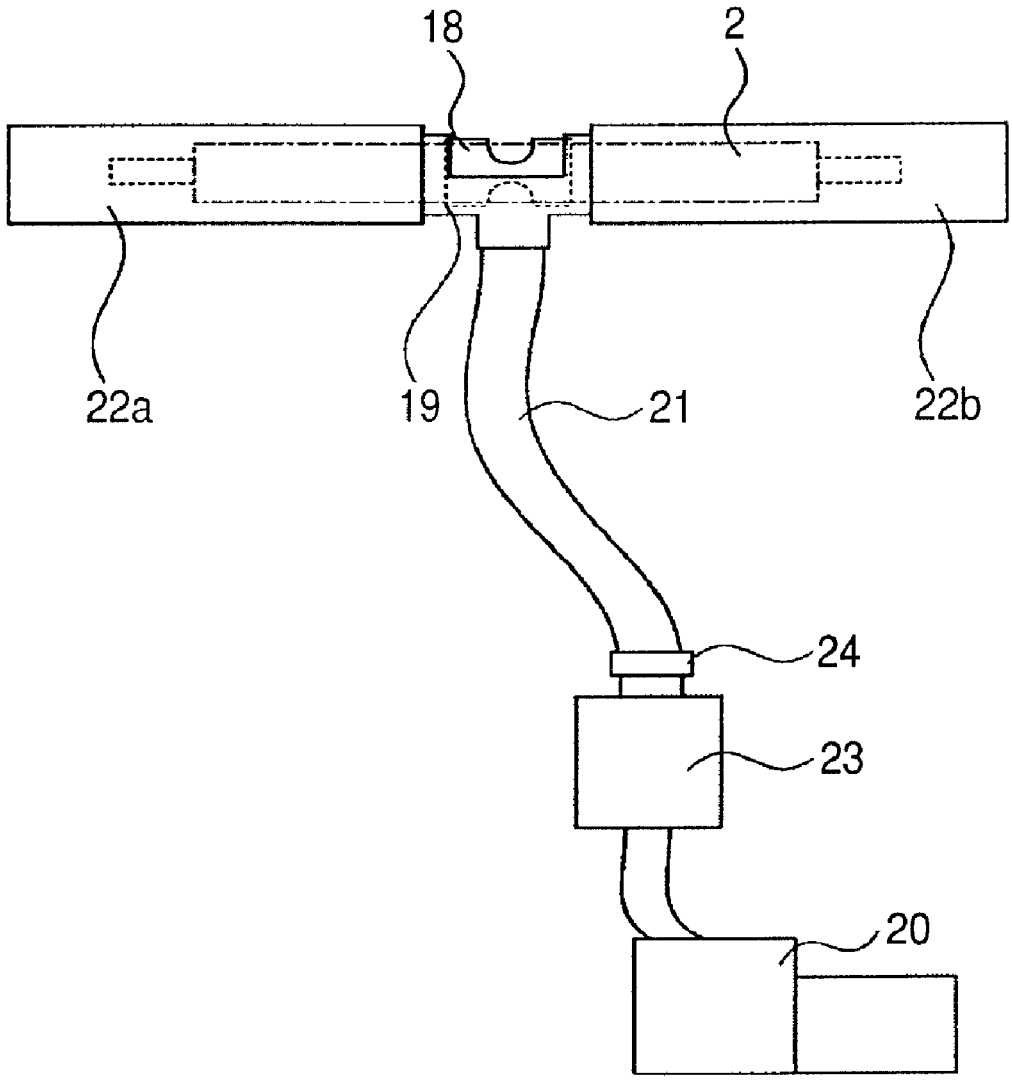
FIG. 2 is a diagram illustrating a method of measuring a "surface aeration amount".

FIG. 2 is a diagram illustrating a method of measuring the "surface aeration amount".

Figure 3:
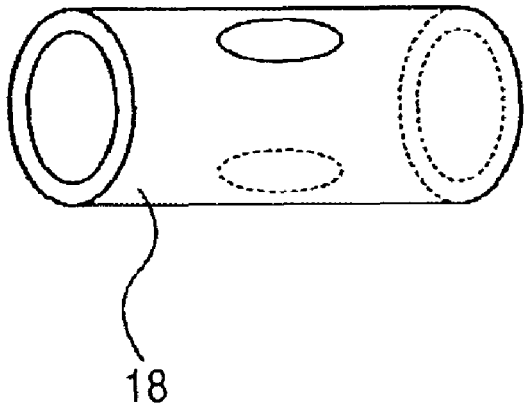
FIG. 3 is a diagram illustrating a fixture used for measuring an aeration amount.

First, the supplying roller 2 of the embodiment of the present invention is inserted in a measuring jig 18 as illustrated in FIG. 3. The measuring jig 18 illustrated in FIG. 3 is a hollow cylindrical member with through holes having a diameter of 10 (mm) formed on the side surface, so the center axis of the through holes is perpendicular to the axis of the cylinder. An inner diameter of the hollow cylindrical member is 1 mm smaller than the outer diameter of the supplying roller to be measured. Thus, a gap between the inner surface of the cylindrical member of the measuring jig 18 and the supplying roller to be measured is eliminated. The supplying roller 2 of the embodiment of the present invention has an outer diameter of 13 (mm), and an inner diameter of the measuring jig 18 is 12 (mm).

Figure 4:
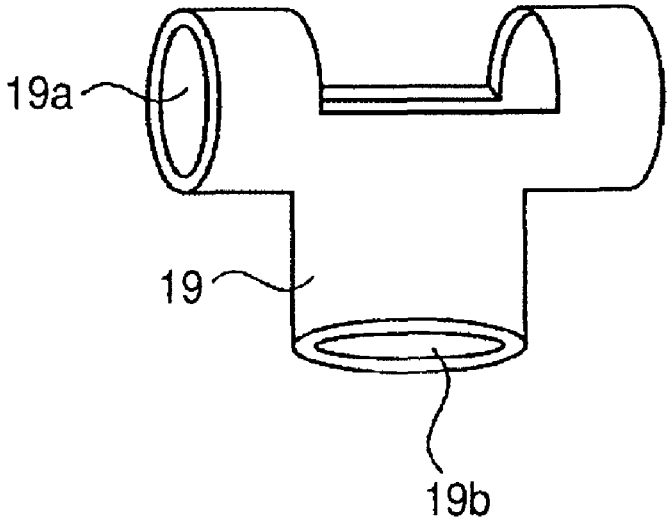
FIG. 4 is a diagram illustrating an aeration holder used for measuring the aeration amount.

The measuring jig 18 in which the supplying roller 2 is inserted is attached to an aeration holder 19 as illustrated in FIG. 4. The aeration holder 19 includes a hollow cylindrical member 19*a* and a coupling tube 19*b* for attaching an aeration tube 21 communicating with a decompression pump 20, and the coupling tube 19*b* is connected to the side surface of the hollow cylindrical member 19*a* so as to form a T-shape. A part of the hollow cylindrical member 19*a* opposite to the part connected to the coupling tube 19*b* largely cut out. An inner diameter of the coupling tube 19*b* is selected to be larger than the through hole of the measuring jig 18. In the embodiment of the present invention, the inner diameter of the coupling tube 19*b* is selected to be 12 (mm). An inner diameter of the hollow cylindrical member 19*a* of the aeration holder 19 is substantially the same as the outer diameter of the measuring jig 18, so the measuring jig 18 can be inserted in the hollow cylindrical member 19*a*. As illustrated in FIG. 2, one of the through holes of the measuring jig 18 is exposed to the cut-out part of the hollow cylindrical member 19*a* completely, and the other through hole is substantially opposed to the inner diameter of the coupling tube 19*b*.

As illustrated in FIG. 2, acrylic tubes 22*a* and 22*b* each having a closed end are disposed at the left and the right sides of the hollow cylindrical member 19*a* of the aeration holder 19 so as to be connected to the hollow cylindrical member 19*a*. A supplying roller that protrudes from the measuring jig 18 at both ends in the left and the right direction is housed in the acrylic tubes 22*a* and 22*b*.

A flowmeter 23 (KZ type aeration amount measuring instrument by DAIEI KAGAKUSEIKI SEISAKUSHO) and a differential pressure control valve 24 are disposed in the aeration tube 21.

The connection parts of the measuring jig 18, the aeration holder 19, the aeration tube 21, and the acrylic tubes 22*a* and 22*b* are sealed with tape or grease, so air flows in only through the exposed through hole of the measuring jig 18 when the decompression pump 20 evacuates the inside of the aeration tube 21.

The measurement of the "surface aeration amount" is performed as follows. First, as illustrated in FIG. 2, the decompression pump 20 is operated in the state where the supplying roller 2 is not disposed. Then, the differential pressure control valve 24 is adjusted so that a measured value of the flowmeter 23 becomes 10.8 (liters per minute) stably. After that, the supplying roller 2 to be measured is disposed, and the above-mentioned sealing is performed carefully. Then, the measured value of the flowmeter 23 is measured as the "surface aeration amount" under the same evacuation condition as described above. As a matter of course, the "surface aeration amount" is measured when the measured value of the flowmeter 23 becomes sufficiently stable.

The airflow passing through the supplying roller 2 flows in from the surface of the urethane foam layer 2*b* disposed at the exposed through hole of the measuring jig 18, and passes through the inside of the urethane foam layer 2*b*. Then, it flows out of the surface of the urethane foam layer 2*b* disposed at the other through hole of the measuring jig 18.

The surface of the urethane foam layer 2*b* of the supplying roller 2 is usually different from the inside of the urethane foam layer 2*b* in many cases. For instance, if the supplying roller 2 is foamed in a mold to be formed, a skin layer having a rate of opening of surface cells different from cells of the inside may appear on the surface. In addition, there is another type of urethane foam layer 2*b*, which has a surface that is not a simple cylindrical surface but instead has intentional projections and depressions. The toner powder flow going in and out of the urethane foam layer 2*b* may be affected by the state of the surface, and it is difficult to capture the behavior thereof by only the measurement of the bulk aeration amount like JIS-L1096. Therefore, the embodiment of the present invention adopts the aeration amount measuring method of measuring the airflow flowing in and out of the surface of the urethane foam layer 2*b* as described above, which is used as a main parameter for realizing the equilibrium state of the toner powder flow described above (or a state close thereto). In other words, the inventors found that the parameter is important.

The developing roller 1 is rotated in the direction indicated by the arrow A as illustrated in FIG. 1, and the supplying roller 2 is rotated in the direction indicated by the arrow B as illustrated in FIG. 1, respectively. A distance between centers of the rotations is selected to be 11 (mm). A hardness of the above-mentioned urethane foam layer 2*b* is sufficiently softer than the silicone rubber layer 1*b* and the acrylic urethane rubber layer 1*c*. Therefore, the surface of the developing roller 1 contacts with the urethane foam layer 2*b* while deforming the same by 1.5 (mm) at most. The maximum deformation amount is a maximum distance between a position of the surface of the urethane foam layer 2*b* when the urethane foam layer 2*b* is not contacted with the developing roller 1 and a position of the surface of the urethane foam layer 2*b* when the urethane foam layer 2*b* is contacted with the developing roller 1 and is deformed as a normal operation. This maximum deformation amount is referred to as an inroad amount of the developing roller 1 with respect to the supplying roller 2.

A rotation speed of the developing roller 1 is 130 (rpm), and a rotation speed of the supplying roller 2 is 100 (rpm). When the developing roller 1 and the supplying roller 2 rotate, the urethane foam layer 2*b* is deformed at the contact part contacting with the developing roller 1. On this occasion, the toner T retained on the surface or the inside of the urethane foam layer 2*b* of the supplying roller 2 is delivered from the surface of the urethane foam layer 2*b* when the urethane foam layer 2*b* is deformed, and a part of the toner T is transferred onto the surface of the developing roller 1. The toner T transferred onto the surface of the developing roller 1 is regulated to be uniform on the developing roller 1 by a regulating blade 5 that is the developer regulating member disposed downstream in the rotational direction of the developing roller 1 with respect to the contact part. In the process described above, the toner T is rubbed at the contact part between the developing roller 1 and the supplying roller 2 or a regulation part between the developing roller 1 and the regulating blade 5, so the toner T obtains a desired triboelectrification charge (negative charge in this embodiment). In addition, since the developing roller 1 and the supplying roller 2 are rotated in the opposite directions at their contact parts as illustrated in FIG. 1, the development remaining toner on the developing roller 1 is scratched and removed by the supplying roller 2. When the urethane foam layer 2*b* passes the contact part with the developing roller 1 so as to become free from the deformation by the pressure of the developing roller 1, the toner is sucked into the inside of the urethane foam layer 2*b*.

Figure 5A:
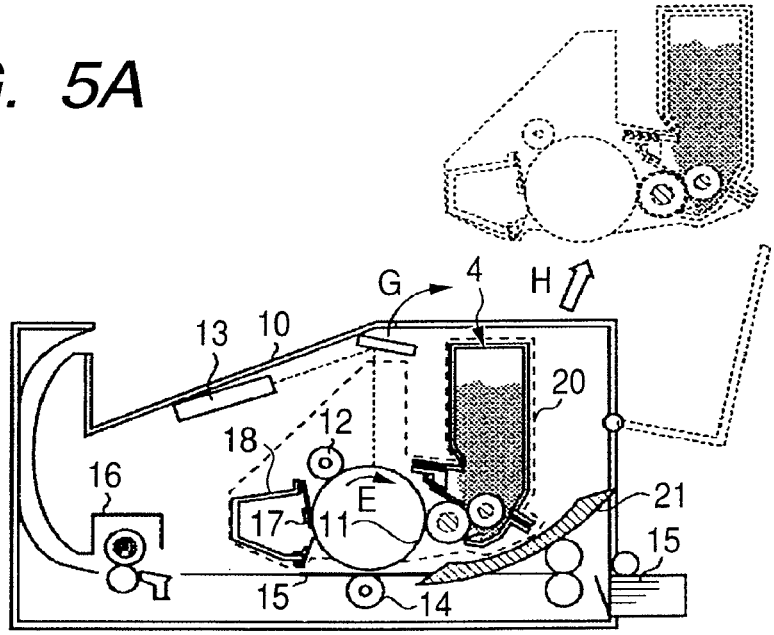
FIG. 5A is a schematic cross sectional view of an image forming apparatus including the developing apparatus to which the present invention is applied.

Next, an operation of the developing apparatus according to the embodiment of the present invention when it is attached to the image forming apparatus will be described with reference to FIGS. 5A, 5B, and 5C. FIG. 5A is a schematic cross sectional view of an image forming apparatus 10 including the developing apparatus to which the present invention is applied.

In FIG. 5A, a photosensitive drum 11 as an image bearing member rotates in the direction indicated by the arrow E. First, the photosensitive drum 11 is charged uniformly to a negative potential by a charging roller 12 as an electrification device. After that, a laser beam from a laser optical device 13 as an exposure means exposes the photosensitive drum 11 so that an electrostatic latent image is formed on a surface thereof.

This electrostatic latent image is developed by the developing apparatus 4, so it is visualized as a toner image. The toner is adhered to the exposed parts of the photosensitive drum, so it is developed reversely in the embodiment of the present invention.

The visualized toner image on the photosensitive drum 11 is transferred onto a recording medium 15 as a transferring material by a transferring roller 14. Untransferred remaining toner that remains on the photosensitive drum 11 is scratched by a cleaning blade 17 as a cleaning member and stored in a waste toner container 18. The cleaned photosensitive drum 11 repeats the action described above so as to form images. On the other hand, the toner image transferred onto a recording medium 6 is fixed permanently by a fixing device 16 and is delivered out of the apparatus.

In the embodiment of the present invention, the developing apparatus 4 is disposed as a cartridge 20 that integrally includes the photosensitive drum 11, the charging roller 12, the cleaning blade 17, and the waste toner container 18. The cartridge 20 is detachably mountable to a main body of the image forming apparatus. The user can open a window on the upper portion of the image forming apparatus in the direction indicated by the arrow G in FIG. 5A and pull out the cartridge 20 along a guide 21 inside the image forming apparatus in the direction indicated by the arrow H in FIG. 5A.

In the embodiment of the present invention, a DC voltage of −1000 volts is applied to the charging roller 12 so that the surface of the photosensitive drum 11 is charged at approximately −500 volts. This potential is referred to as a dark section potential Vd. During a period of time until the potential Vd of the photosensitive drum becomes stable, the developing apparatus 4 is maintained in the state where the developing roller 1 is separated from the photosensitive drum 11 as illustrated in FIG. 5C. A separation cam 42 is attached to the main body of the image forming apparatus and can be rotated by a drive means and a drive transmission means (not shown) provided to the main body of the image forming apparatus. In this case, the separation cam 42 is in a separation position B so as to press a predetermined position on the backside of the developing apparatus 4. For instance, during a pre-rotation period and a post-rotation period of the photosensitive drum 11, the state where the developing roller 1 is separated from the photosensitive drum 11 is maintained.

The developing apparatus has a force receiving portion 43 for receiving a force to move the developing container between a first position where the developing operation is performed by the developing roller and a second position where the developing operation is not performed. The force receiving portion 43 is provided to the predetermined position on the backside of the developing apparatus 4 of the cartridge. The force receiving portion 43 has a surface slip property necessary for rotating and contacting with the separation cam 42 and a hardness to resist deformation in the separate state where the largest force is exerted in the embodiment of the present invention.

When the separation cam 42 rotates, a cam surface of the cam 42 presses the force receiving portion 43 of the cartridge, so the developing apparatus 4 rotates around a swing center 40 as the rotation axis and overcomes a reaction force of a press spring 41 disposed between the developing apparatus 4 and the waste toner container 18. When the developing apparatus 4 swings, the developing roller 1 is moved from a contact position (FIG. 5B) to a separation position (FIG. 5C) with respect to the photosensitive drum 11.

A posture position of the developing apparatus to make the developing roller 1 contact with the photosensitive drum 11 is referred to as a first position (developing position), and a posture position of the developing apparatus to make the developing roller 1 separate from the photosensitive drum 11 is referred to as a second position (non-developing position). In the second position, the developing apparatus does not perform the developing operation.

After the potential Vd of the photosensitive drum becomes stable, the photosensitive drum 11 is exposed by the laser beam from the laser optical device 13 as the exposure means, so the electrostatic latent image is formed on the surface thereof. A surface potential of the exposed part becomes approximately −100 volts. This potential is referred to as a light section potential Vl. In addition, the developing roller 1 and the supplying roller 2 start to rotate at a predetermined timing driven by the drive means provided to the main body of the image forming apparatus and the drive transmission means (not shown), so as to prepare for the developing step of the electrostatic latent image. Before the developing step, the developing apparatus is moved from the second position to the first position. Therefore, the first position of the developing apparatus is the position where the developing roller 1 contacts with the photosensitive drum 11 so as to develop the electrostatic latent image formed on the photosensitive drum 11.

Figure 5B:
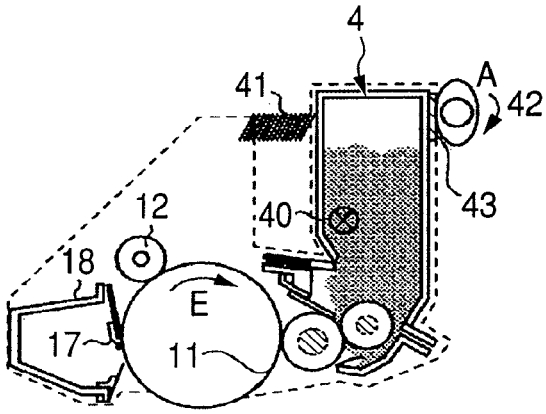
FIG. 5B is a diagram illustrating the developing apparatus in a contact state.

For instance, the separation cam 42 is rotated so that the drive means provided to the main body of the image forming apparatus makes the developing apparatus become the separation position (non-developing position) A as illustrated in FIG. 5B. In the separation position A, the force pressing the force receiving portion 43 on the backside of the developing apparatus 4 is released. Therefore, the force of the press spring 41 disposed between the developing apparatus 4 and the waste toner container 18 drives the developing apparatus 4 to rotate around the swing center 40 as the rotation axis so that the developing roller 1 abuts the photosensitive drum 11 (see FIG. 5B). On this occasion, a DC voltage of −300 volts as the developing bias is applied to the developing roller 1 at a predetermined timing.

The first position of the developing apparatus is the position where the developing roller 1 abuts the photosensitive drum 11 in this way, so the electrostatic latent image formed on the photosensitive drum 11 is developed.

After the development of the electrostatic latent image is completed, i.e., during the post-rotation period of the photosensitive drum 11, the separation cam 42 rotates again to the separation position B. Thus, the separation cam 42 presses the force receiving portion 43 on the backside of the developing apparatus 4, so the developing apparatus 4 rotates around the swing center 40 as the rotation axis. The pressing force overcomes the reaction force of the press spring 41 disposed between the developing apparatus 4 and the waste toner container 18, so the developing roller 1 is separated from the photosensitive drum 11. In other words, the developing apparatus 4 is moved again to the second position.

At the same time, the rotation drive of the developing roller 1 and the supplying roller 2 is stopped, so the application of the developing bias of the developing roller 1 is stopped.

In the embodiment of the present invention, the capacitance between the developing roller and the supplying roller can be detected in the second position (FIG. 5C) where the developing roller 1 is separated from the photosensitive drum 11, so the toner remaining amount in the developing apparatus 4 can be detected.

Figure 6:
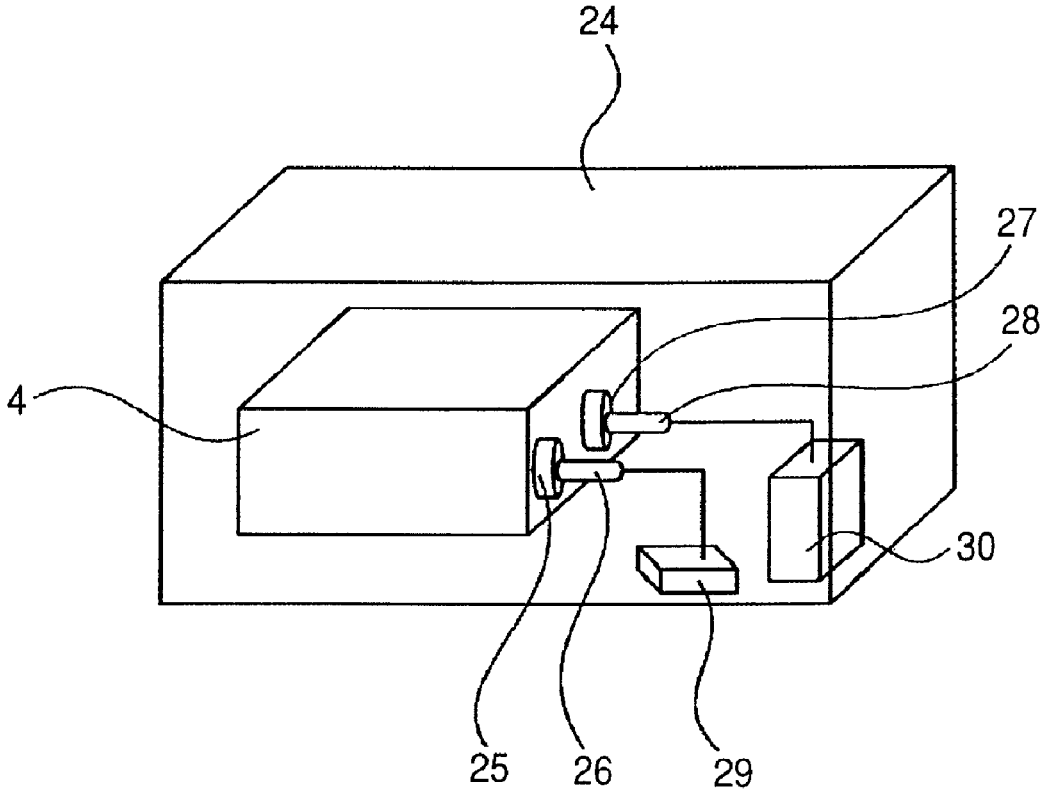
FIG. 6 is a block diagram of the image forming apparatus and the developing apparatus.
Figure 7:
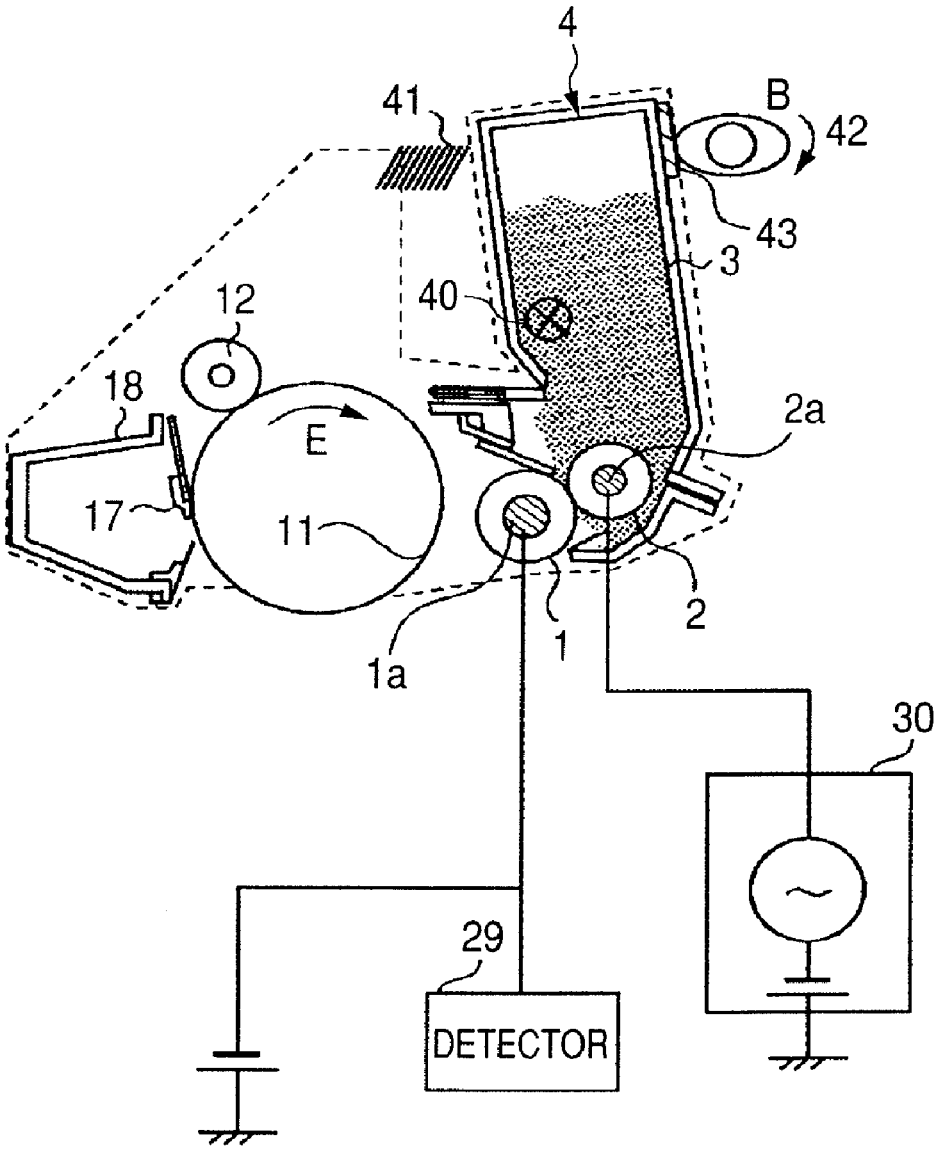
FIG. 7 is a block diagram of a detecting device of the embodiment of the present invention.

With reference to FIGS. 6 and 7, a method of detecting the toner remaining amount according to the present embodiment will be described, in which a change in capacitance is utilized.

FIG. 6 illustrates the state where the developing apparatus 4 of the embodiment of the present invention is disposed in the image forming apparatus 10. A contact electrode 25 of the developing apparatus is connected electrically to the core metal electrode la of the developing roller 1. The main body of the image forming apparatus 10 has a contact electrode 26 corresponding to the contact electrode 25, and the contact electrode 26 is connected electrically to a detector 29 as the capacitance detecting device inside the main body of the image forming apparatus 10. In the same manner, the developing apparatus has a contact electrode 27 connected electrically to the core metal electrode 2*a* of the supplying roller 2, while the main body of the image forming apparatus 10 has a contact electrode 28 corresponding to the contact electrode 27. The contact electrode 28 is connected electrically to an AC bias power supply 30 for detection inside the main body of the image forming apparatus 10. In this way, the contact electrodes 25 and 27 are provided to the cartridge, while the contact electrodes 26 and 28 are provided to the main body of the image forming apparatus. In the state where the developing apparatus is disposed at a predetermined position inside the image forming apparatus 10, the contact electrodes 25 and 26 as well as the contact electrodes 27 and 28 are connected to each other electrically in both the first and second positions. In the first position, the developing roller 1 abuts the photosensitive drum 11. In the second position, the developing roller 1 is separated from the photosensitive drum 11.

In other words, even when the developing apparatus 4 swings between the first position and the second position, the contact electrode 25 and the contact electrode 26 as well as the contact electrode 27 and the contact electrode 28 remain in a contact state with each other. In the normal developing operation, the developing apparatus is in the first position, and a developing bias (DC voltage) is applied to the electrode 25 via the electrode 26. On this occasion, the same voltage as the developing bias is applied to the electrode 27 via the electrode 28. Therefore, the electrode 25 and the electrode 27 have the same potential in the developing operation, so no electric field is formed between the developing roller and the supplying roller. In this way, the capacitance detecting device 29 and the AC bias power supply 30 are switched to be connected to the developing bias power supply in the developing operation.

Next, as illustrated in FIG. 7, the developing apparatus becomes the second position in a non-developing operation. In the embodiment of the present invention, the bias power supply 30 applies a toner remaining amount detecting bias to the conductive core metal 2*a* of the supplying roller 2, so the toner remaining amount in the developing apparatus 4 is detected. An AC bias having a frequency of 50 KHz and a peak-to-peak voltage of Vpp=200 volts is used as the toner remaining amount detecting bias.

A voltage is induced at the conductive core metal 1*a* of the developing roller 1 by the toner remaining amount detecting bias applied to the core metal 2*a*, and this voltage is detected by the detector 29.

The second position where the developing operation is not performed, i.e., the state where the photosensitive drum 11 is separated from the developing roller 1 corresponds to the non-developing operation. More specifically, this state can be realized by a device operation, for instance, a period of time between paper sheets without image formation or during a period of time after the end of the image formation step until the recording medium 15 is delivered out of the image forming apparatus (a so-called post-rotation operation). Of course, it is possible to place the developing apparatus in the second position before the image formation and during a drum pre-rotation operation.

On this occasion, since the photosensitive drum 11 is separated from the developing roller 1 in this second position, smear on a white background called fog does not appear when an AC bias is applied as the toner remaining amount detecting bias. In addition, since the photosensitive drum 11 is separated from the developing roller 1, an undesirable hitting noise, due to impact and vibration between the developing roller and the photosensitive drum when they contact each other, is not generated.

Since the AC bias for detecting the toner remaining amount is applied from the conductive core metal 2*a* of the supplying roller 2 to the developing roller 1 that is used as a capacitance detecting antenna, it is possible to prevent an inhibition of conveying toner that may occur in the structure having a separate special antenna in the developing chamber.

Figure 5C:
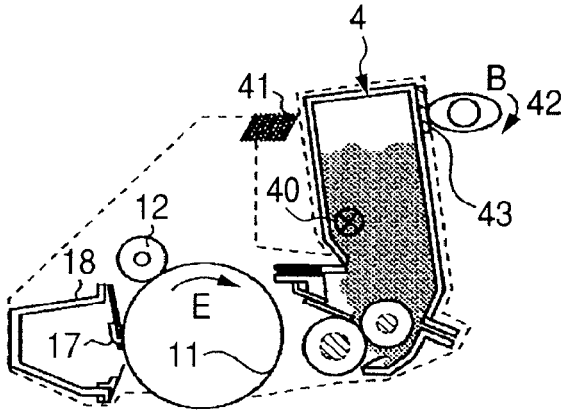
FIG. 5C is a diagram illustrating the developing apparatus in a separate state.

The posture of the developing apparatus 4 is naturally changed in the abutting and separating operation between the photosensitive drum 11 and the developing roller 1, i.e., between the first position where the developing operation is performed and the second position where the developing operation is not performed as illustrated in FIGS. 5B and 5C. As a result, the toner is also moved.

On this occasion, the AC bias for detecting the toner remaining amount is applied from the conductive core metal 2*a* of the supplying roller 2 to the developing roller 1 that is used as the capacitance detecting antenna in the developing apparatus 4 of the present embodiment, so a change in capacitance of the toner contained in the supplying roller 2 is measured. Therefore, the amount of toner contained in the supplying roller 2 does not change even if the posture of the developing apparatus 4 as well as the toner T moves along with the abutting and separating operation. In other words, the amount of toner between the developing roller 1 and the antenna (supplying roller) does not change, so the voltage output induced in the antenna does not change. Therefore, since the supplying roller 2 has the foam layer into which the toner can enter, the toner in the foam layer is hardly moved even if the posture of the developing apparatus changes. As a result, the voltage output does not change.

In addition, as to a nonmagnetic mono-component contact developing apparatus 4 according to the present embodiment, drive of the developing roller 1 and the supplying roller 2 is stopped during the detection of the capacitance of remaining toner, i.e., in the state where the developing roller 1 is separated from the photosensitive drum 11.

When the drive of the developing roller 1 and the supplying roller 2 is stopped, and the toner supply operation to the developing roller 1 and the removing operation of non-developing toner are stopped, the amount of toner contained in the supplying roller 2 becomes constant during the toner remaining amount detection, resulting in improvement of accuracy of the toner remaining amount detection.

Figure 8:
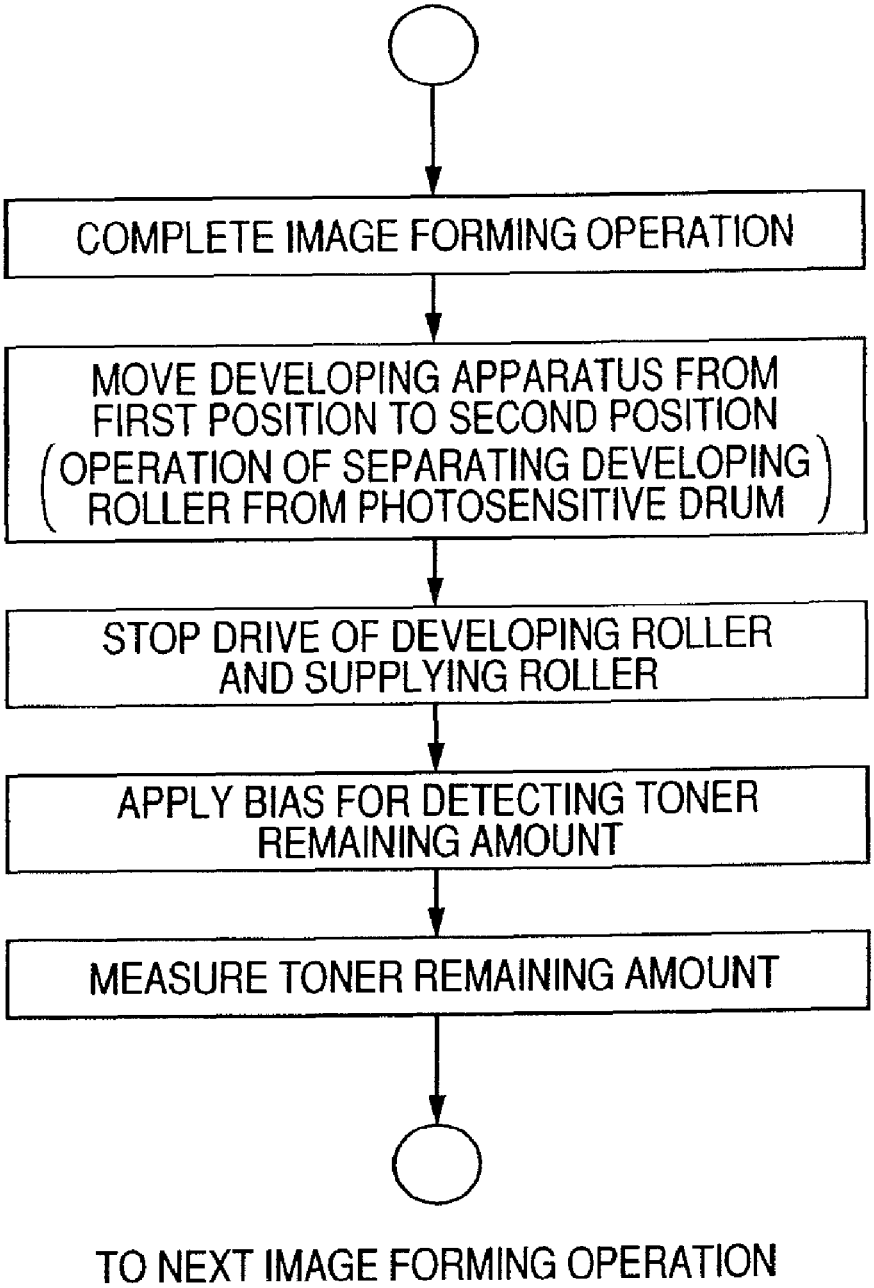
FIG. 8 is a flowchart illustrating a toner remaining amount detecting process according to the embodiment of the present invention.

FIG. 8 illustrates a flowchart of the toner remaining amount detection according to the embodiment of the present invention. As to the timing of the toner remaining amount detection, the developing apparatus moves from the first position to the second position after completion of the image forming operation. Then, the developing roller 1 separates from the photosensitive drum 11, and the drive of the developing roller 1 and the supplying roller 2 is stopped. After that, the toner remaining amount detecting bias is applied so that the toner remaining amount detection is performed.

Figure 9:
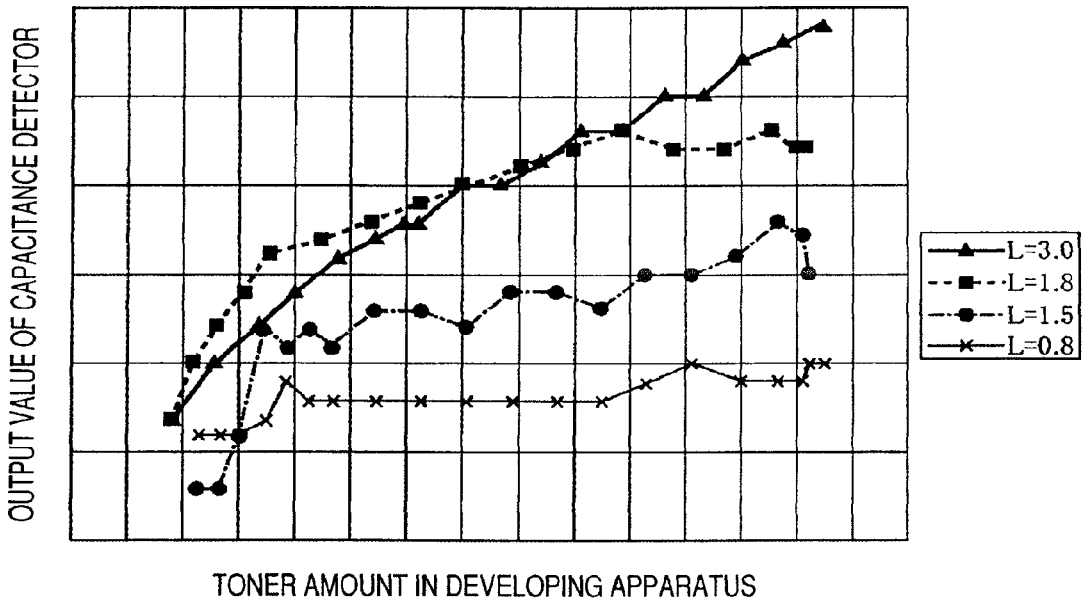
FIG. 9 is a graph illustrating a relationship between the toner amount in the developing apparatus and an output of the capacitance detector.

In FIG. 9, triangular dots and full line illustrates the output value of the capacitance detecting device 29 in the case where the toner T fills the developing apparatus 4 of the embodiment of the present invention and is consumed gradually. In the embodiment of the present invention, the surface aeration amount L of the supplying roller is 3.0 (liters per minute). A temperature and humidity environment of the measurement is 23 degrees centigrade and 60% Rh. As illustrated in FIG. 9, the remaining amount of toner T in the developing apparatus 4 and the output value of the capacitance detecting device 29 have relatively linear and good correlation in their changes according to the structure of the developing unit of the embodiment of the present invention. In a display of the toner amount, a reference value is set so that the output value of the capacitance detecting device 29 is compared with the reference value. If the output value of the capacitance detecting device 29 is lower than the reference value, an out of toner state is decided. If the out of toner state is decided, a warning indicating "out of toner" or the like may be displayed on the main body of the image forming apparatus or a computer or the like connected to the image forming apparatus, or the image forming operation of the image forming apparatus may be stopped. In addition, if a detachably mountable process cartridge is used for the main body of the image forming apparatus, it is possible to inform a timing for replacing the cartridge by the main body of the image forming apparatus. In addition, as illustrated in FIG. 9, it is possible to display a warning indicating "a little toner remaining amount" or the like at a desired toner remaining amount of the toner T in the developing apparatus 4 since there is a correlation between the toner amount and the output value of the capacitance detecting device 29. Further, multiple reference values may be set so as to display various levels of warnings about the toner remaining amount. For instance, a current toner remaining amount while the toner is consumed may be displayed in percent in stages when a toner amount of a new developing container is regarded as 100%.

For instance, some supplying rollers having different values of the surface aeration amount according to the embodiment of the present invention were made by changing a foam ratio of the foam layer of the supplying roller. Then, each of the supplying rollers is incorporated in the developing apparatus having the same structure as example 1, so as to compare with a result of the output of example 1 (the surface aeration amount of the supplying roller is 3.0 (liters per minute)).

As example 2, square dots and broken line of FIG. 9 illustrate output values measured under the same condition using the developing apparatus with the supplying roller having the urethane foam layer in which the surface aeration amount is 1.8 (liters per minute).

As comparison example 1, circular dots and broken line of FIG. 9 illustrate output values measured under the same condition using the developing apparatus with the supplying roller having the urethane foam layer in which the surface aeration amount is 1.5 (liters per minute).

As comparison example 2, dots of x and thin full line of FIG. 9 illustrate output values measured under the same condition using the developing apparatus with the supplying roller having the urethane foam layer in which the surface aeration amount is 0.8 (liters per minute).

Comparing the embodiments 1 and 2 of the present invention with the comparison examples, it is understood that the output value has little change in comparison examples 1 and 2 from the start of use until the timing when a half or more of the toner T is consumed, and a change in the output appears when the amount of the toner T becomes substantially small.

Figure 10:
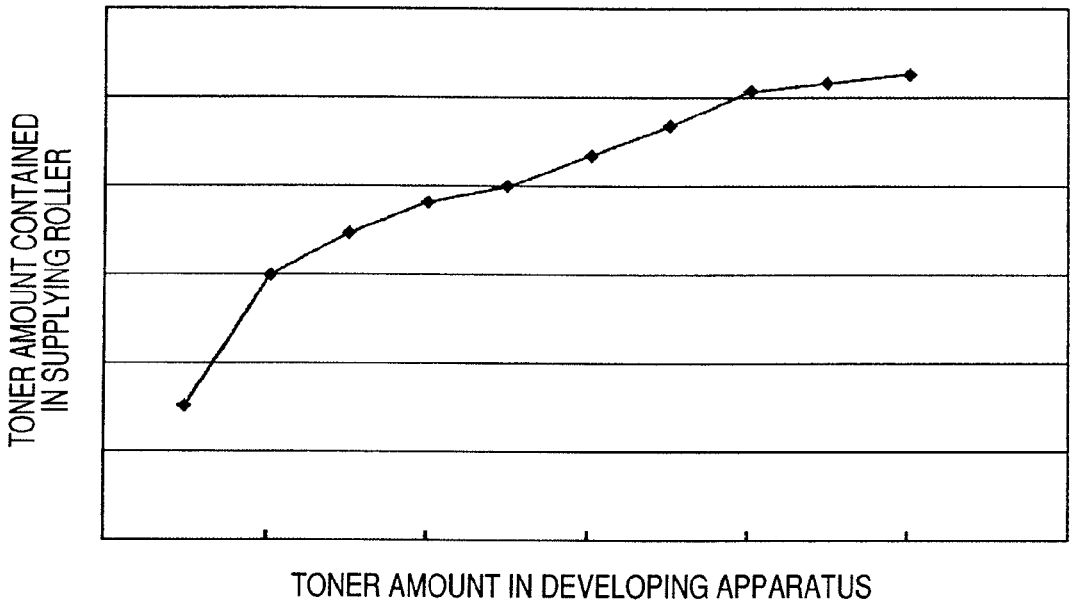
FIG. 10 is a graph illustrating a relationship between the toner amount in the developing apparatus and toner amount contained in a supplying roller.

FIG. 10 illustrates a relationship between the remaining amount of toner T in the developing apparatus 4 and the amount of toner contained in the supplying roller 2 in example 1. As to the relationship plotted in FIG. 10, the toner T was consumed under the same condition as in FIG. 9. After measuring the capacitance values for different amounts of remaining toner, the supplying roller 2 was drawn out so that the amount of toner T contained in the supplying roller 2 was measured (difference with a weight of the supplying roller 2 before the use was determined). As illustrated in FIG. 10, it is understood that the amount of remaining toner in the developing apparatus and the amount of toner contained in the supplying roller have relatively linear and good correlation in their changes. In other words, if the capacitance is measured by the detecting device 29, the amount of toner in the developing container can be determined with high accuracy.

Note that the aeration amount of the supplying roller described in Japanese Patent Application Laid-Open No. H11-288161 was measured by the method according to the embodiment of the present invention, and a result of the measurement was 0.3 to 1.3 (liters per minute).

Figure 11:
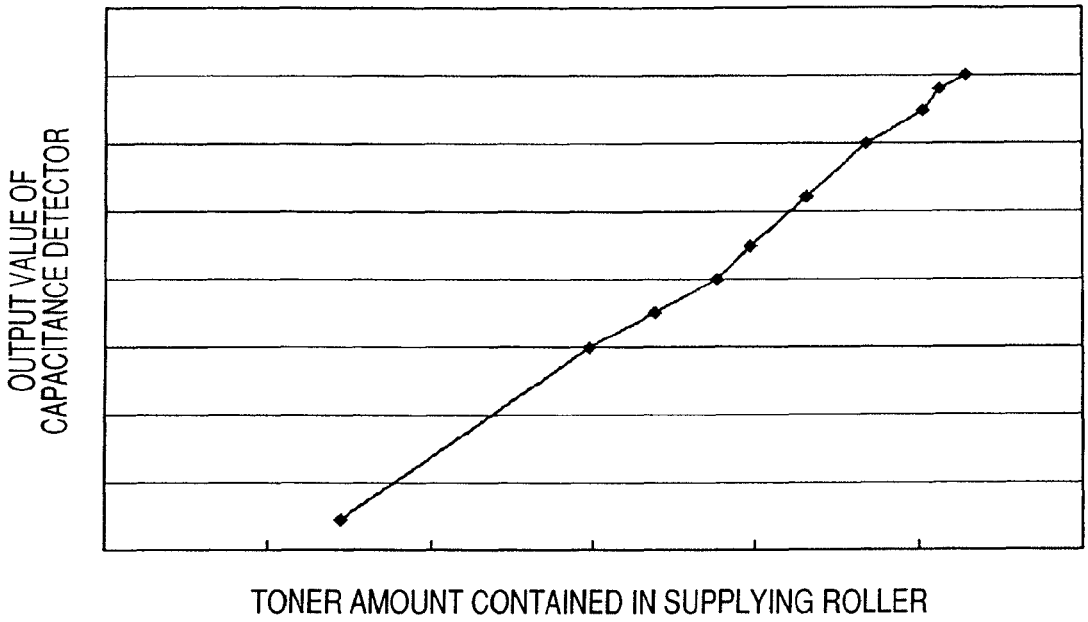
FIG. 11 is a graph illustrating a relationship between the toner amount contained in the supplying roller and the output of the capacitance detector.

In the measurement described above, a relationship between the capacitance output value of the developing apparatus 4 and the amount of toner contained in the supplying roller 2 according to example 1 was plotted as illustrated in FIG. 11. As illustrated in FIG. 11, the capacitance output value of the developing apparatus and the amount of toner in the supplying roller have substantially linear and very good correlation. This indicates that the structure of the embodiment of the present invention can measure appropriately a change of capacitance in the supplying roller 2. In other words, it is understood from FIGS. 10 and 11 that if the capacitance is measured with the detecting device 29, the amount of toner contained in the supplying roller and the amount of toner contained in the developing container can be determined with high accuracy.

Figure 12:
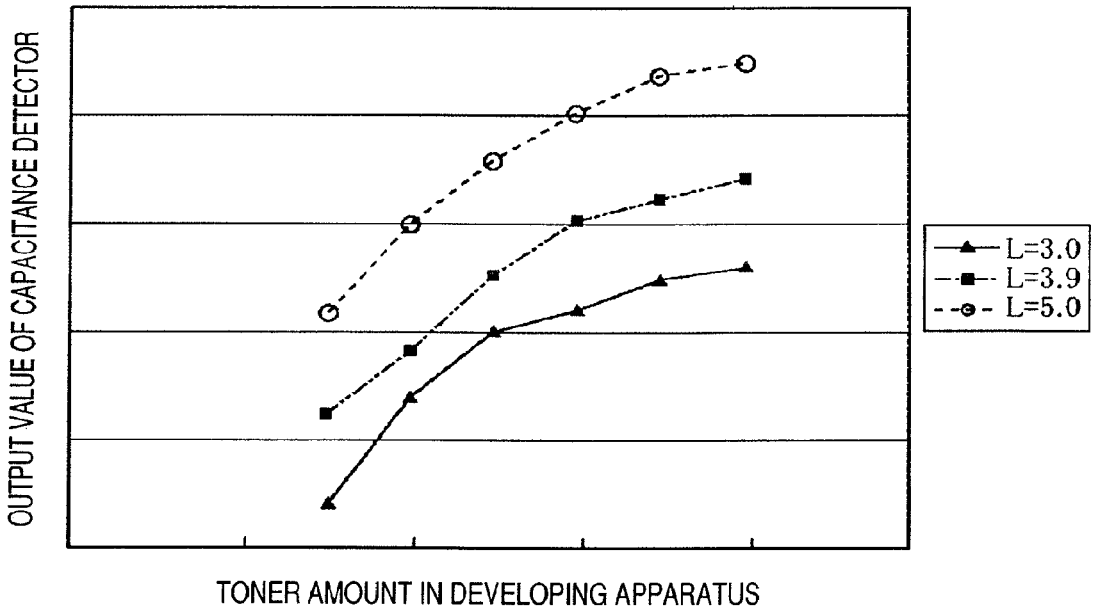
FIG. 12 is a graph illustrating a relationship between the toner amount in the developing apparatus and the output of the capacitance detector.

In addition, some supplying rollers having higher aeration amount values than the supplying roller of embodiment 1 of the present invention are made, so as to compare with the output result of the example 1 by using the developing apparatus having the same structure as example 1. A result of the comparison is illustrated in FIG. 12. An output result of example 1 is illustrated in triangular dots and full line. As example 3, square dots and broken line of FIG. 12 illustrates output values measured under the same condition using the developing apparatus with the supplying roller having the urethane foam layer in which the surface aeration amount is 3.9 (liters per minute). As example 4, circular dots and broken line of FIG. 12 illustrates output values measured under the same condition using the developing apparatus with the supplying roller having the urethane foam layer in which the surface aeration amount is 5.0 (liters per minute).

As illustrated in FIG. 12, an absolute value of the capacitance detection output value increases along with an increase of the aeration amount. However, the variation corresponding to the amount of toner in the developing apparatus is similar for the supplying rollers 2 having the aeration amount within a range of 3 to 5 (liters per minute). In other words, if the supplying roller has the aeration amount of 1.8 (liters per minute) or higher, the detected capacitance output value and the amount of toner in the developing container have good correlation so that accuracy of detecting the remaining toner amount can be improved. In addition, if the aeration amount is large, hole portions in the foam layer of the supplying roller increase so that the strength of the supplying roller decreases. As a result, the foam layer of the supplying roller can be torn easily. In order to prevent this state, it is preferable to select a value of the aeration amount to 5.0 (liters per minute) or smaller. In particular, it is desirable that the aeration amount L should satisfy the expression of $3.0 \leqq L \leqq 5.0$.

As described above, if the aeration amount of the supplying roller is selected appropriately, the amount of toner contained in the supplying roller increases. The amount of toner contained in the supplying roller decreases along with a decrease of the amount of toner stored in the developing container (see FIG. 10). In addition, the output value of capacitance between the developing roller and the supplying roller decreases along with a decrease of the amount of toner in the supplying roller (see FIG. 11). Therefore, it is effective to measure the output value of capacitance between the developing roller and the supplying roller for determining the amount of toner stored in the developing container (see FIG. 12). In order to increase the amount of toner contained in the supplying roller, it is preferable to select an average cell size on the surface of the foam layer of the supplying roller to be a value larger than an average particle diameter of the toner (e.g., a weight average particle diameter).

Note that the toner in the supplying roller is discharged partially when the supplying roller starts to contact with the developing roller so that the supplying roller starts to be deformed. When the supplying roller finishes contacting with the developing roller, the deformation of the supplying roller is restored so that the part of the toner is sucked. In this way, the toner enters and goes out of the supplying roller. The amount of toner in the supplying roller is kept substantially in the equilibrium state as long as the amount of toner in the developing container does not change. In order to measure the output value of capacitance with high accuracy so as to determine the amount of toner in the supplying roller more precisely, it is preferable to measure while stopping the rotation of the supplying roller so that the toner does not enter into or exit from the supplying roller as described above.

The correlation between the amount of remaining toner in the developing apparatus and the amount of toner contained in the supplying roller illustrated in FIG. 10 depends on the degree of compaction of the toner T. The lower the degree of compaction, the easier the toner can enter into and exit from the supplying roller. Therefore, the correlation between the amount of remaining toner in the developing apparatus and the amount of toner contained in the supplying roller is improved. As to the image forming apparatus 10 of the embodiment of the present invention, the image forming operation was performed. Then, the degree of compaction of the toner T remaining in the developing container was measured in the state where the toner T in the developing apparatus was consumed sufficiently. A result of the measurement was 30%. In general, the degree of compaction of the toner T has a tendency to be higher as the toner T in the developing container is consumed more frequently. Therefore, it can be estimated that the degree of compaction of the toner T in the developing apparatus is lower than 30% before the image forming operation is performed.

In other words, if the toner has a degree of compaction equal to or lower than 30%, the toner can be used without any problem for realizing the equilibrium state of the toner entering and exiting the supplying roller, which is a feature of the present invention.

The amount of toner contained in the supplying roller has a correlation with the amount of toner in the toner container. Therefore, if the self-weight of the toner in the toner container is exerted on the supplying roller as it is, the correlation between the amount of remaining toner in the developing apparatus and the amount of toner contained in the supplying roller as illustrated in FIG. 10 increases. Therefore, if the supplying roller is disposed at the opening portion in the toner container as the embodiment of the present invention, the accuracy of detecting remaining toner can be improved.

The image forming apparatus 10 of the example described above has a structure in which the toner remaining amount detecting bias is applied to the supplying roller 2 so that the voltage induced in the developing roller 1 is detected by the disposed detector. However, it is possible to adopt another structure in which a remaining toner detecting bias is applied to the developing roller 1 so that a voltage induced in the supplying roller 2 is detected by a disposed detector, so a similar effect can be obtained.

OTHER EXAMPLE

Further, an example of other exemplary embodiments of the developing apparatus will be described with reference to the attached drawings. However, components and operations of the embodiment described below are similar to those of example 1, so the same reference numerals are used for omitting their description.

Figure 13:
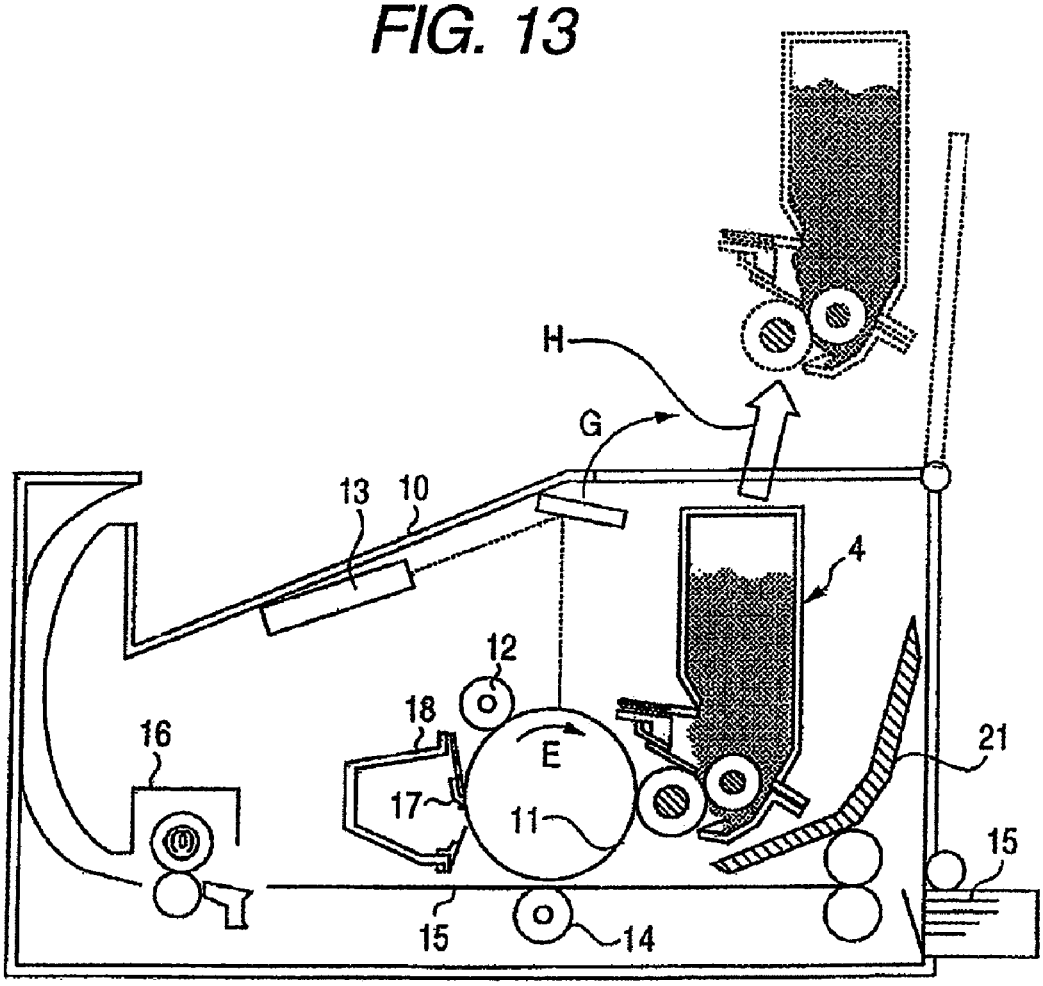
FIG. 13 is another schematic cross sectional view of the image forming apparatus including the developing apparatus to which the present invention is applied.
Figure 14:
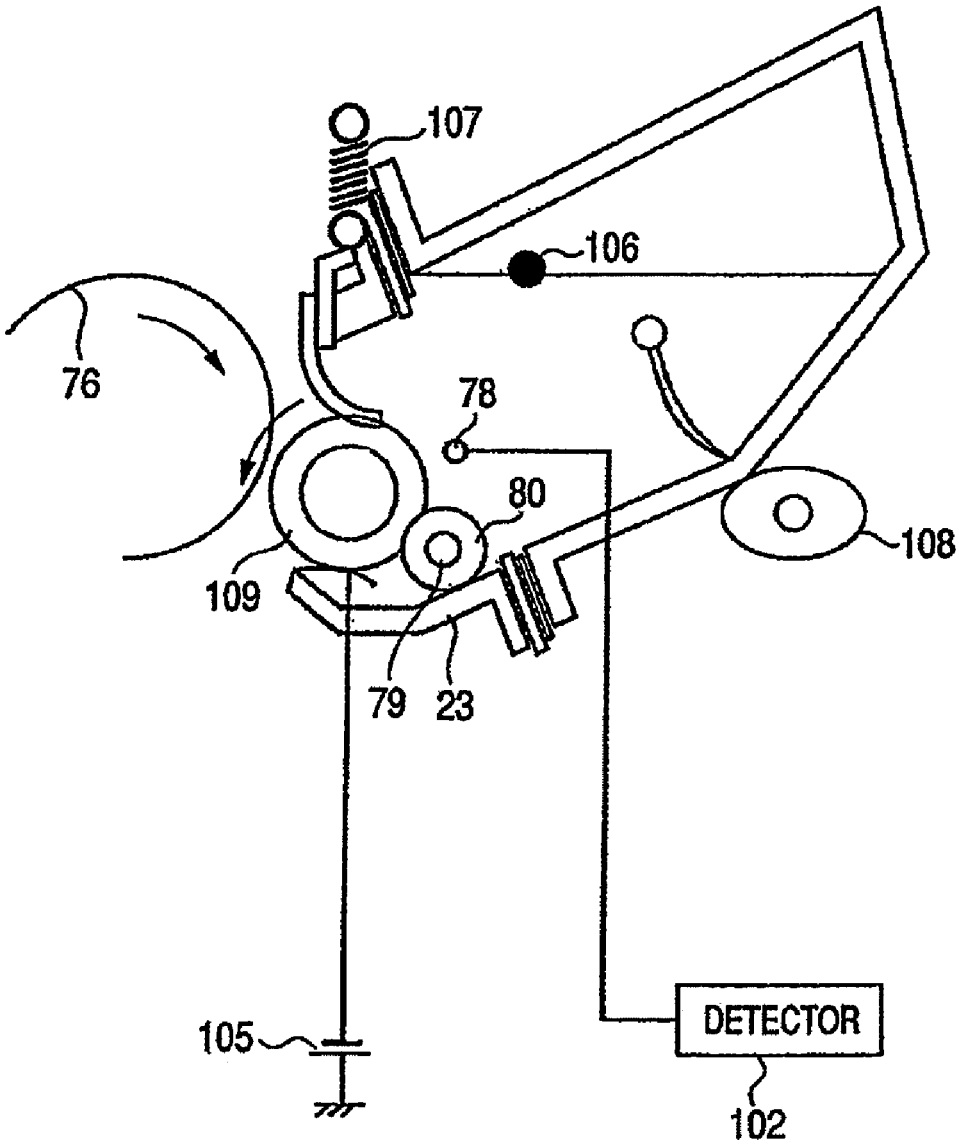
FIG. 14 is a schematic structural diagram illustrating a conventional developing apparatus.
Figure 15:
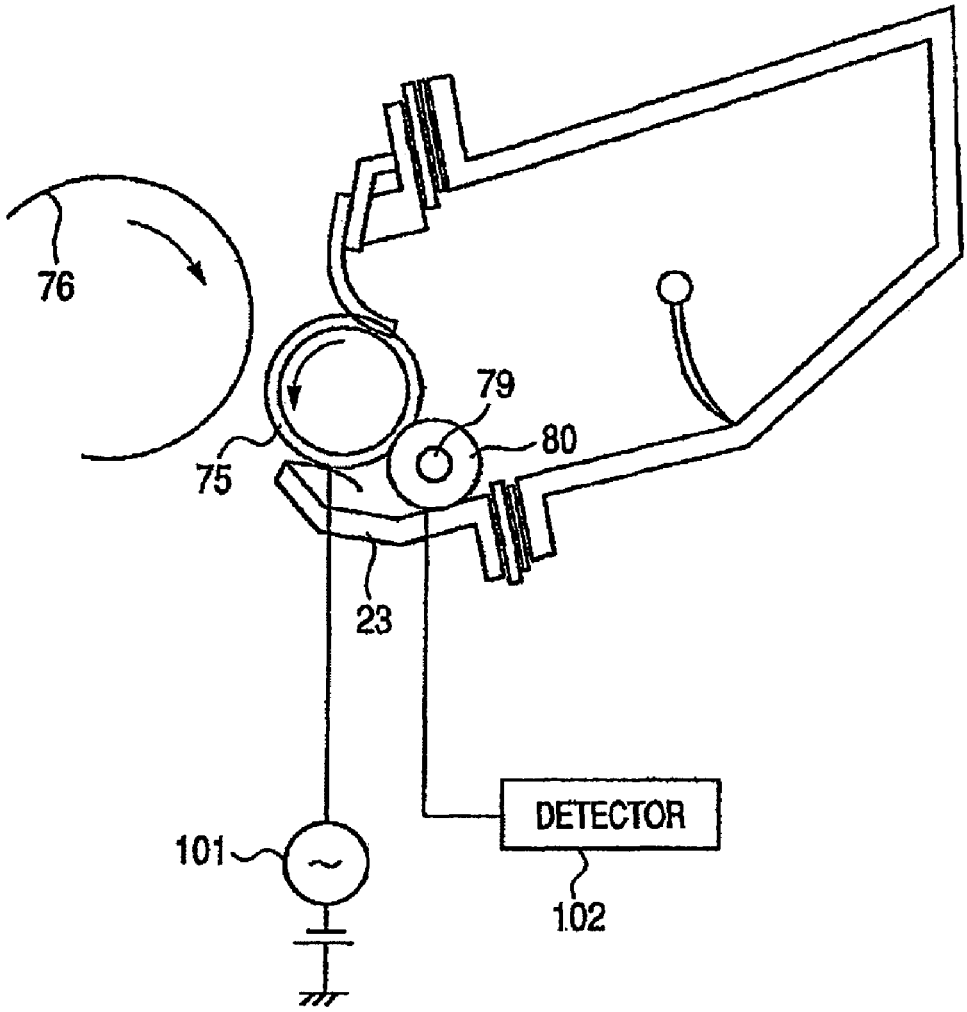
FIG. 15 is another schematic structural diagram illustrating a conventional developing apparatus.

FIG. 13 is a schematic cross sectional view of the image forming apparatus of another example to which the present invention is applied.

The developing cartridge made up of the developing apparatus 4 of FIG. 13 is detachably mountable to a main body of the image forming apparatus. The user can open a window on the upper portion of the image forming apparatus in the direction indicated by the arrow G of FIG. 13 and draw out the developing cartridge along a guide 21 inside the image forming apparatus in the direction indicated by the arrow H of FIG. 13.

The developing apparatus having such a structure can employ the developing apparatus structural portion of the process cartridge described above in the example 1 so that the same effect as example 1 can be obtained. In other words, the cartridge that is detachably mountable to the main body of the image forming apparatus may be the developing cartridge described above in this example or the process cartridge including the photosensitive drum described above in example 1.

According to the present invention, the developer supplying member for supplying the developer to the developer carrying member is also used for detecting the capacitance inside the developing container. Therefore, it is not necessary to provide a dedicated antenna for detecting the capacitance inside the developing container, thus providing advantages of saving space and cost. In addition, conveyance of the developer is not blocked while accurate detection can be performed stably so that accuracy of detecting a developer amount can be improved.

In addition, according to the present invention, the developer amount can be detected accurately even if a posture of the developing apparatus changes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-172291, filed Jun. 29, 2007, which is hereby incorporated by reference herein in its entirety.

What is claimed is:

1. An image forming apparatus, comprising:

a developing apparatus for developing an electrostatic latent image formed on an image bearing member with a developer, the developing apparatus including a developer carrying member for carrying the developer to develop the electrostatic latent image with the developer and a developer supplying member having a foam layer for supplying the developer to the developer carrying member, wherein the developer carrying member includes a core electrode for rotatably supporting the developer carrying member, and wherein the developer supplying member includes a core electrode for rotatably supporting the developer supplying member; and a detector for detecting information relating to capacitance between the core electrode of the developer carrying member and the core electrode of the developer supplying member when applying, in a non-developing duration, an alternating bias to the core electrode of the developer carrying member or the core electrode of the developer supplying member.

2. An image forming apparatus according to claim 1, wherein the foam layer is made of open-cell foam.

3. An image forming apparatus according to claim 1, wherein the developer supplying member is provided in contact with the developer carrying member.

4. An image forming apparatus according to claim 1, further comprising a developer regulating member provided in contact with the developer carrying member for regulating the developer carried on the developer carrying member.

5. A developing apparatus, detachably mountable to an image forming apparatus main body having a detector for detecting information relating to capacitance, for developing an electrostatic latent image formed on an image bearing member with a developer, the developing apparatus comprising:

a developer carrying member for carrying the developer for developing the electrostatic latent image with the developer, the developer carrying member including a core electrode for rotatably supporting the developer carrying member;

a developer supplying member having a foam layer for supplying the developer to the developer carrying member, the developer supplying member including a core electrode for rotatably supporting the developer supplying member;

a first contact electrode connectable to an alternating bias source provided in the image forming apparatus main body for applying, in a non-developing duration, an alternating bias to the core electrode of the developer carrying member or the core electrode of the developer supplying member; and a second contact electrode connectable to the detector for detecting the information relating to capacitance between the core electrode of the developer carrying member and the core electrode of the developer supplying member when applying the alternating bias to the core electrode of the developer carrying member or the core electrode of the developer supplying member.

6. A developing apparatus according to claim 5, wherein the foam layer is made of open-cell foam.

7. A developing apparatus according to claim 5, wherein the developer supplying member is provided in contact with the developer carrying member.

8. A developing apparatus according to claim 5, further comprising a developer regulating member provided in contact with the developer carrying member for regulating the developer carried on the developer carrying member.

9. A process cartridge detachably mountable to an image forming apparatus main body, the process cartridge integrally comprising:

a developing apparatus as recited in claim 5; and an image bearing member.

* * * * *